US005286585A

United States Patent [19]

Lee

[11] Patent Number: 5,286,585

[45] Date of Patent: Feb. 15, 1994

[54] METHOD OF FORMING A PHOSPHOR LAYER ON THE SCREEN PANEL OF A CATHODE-RAY TUBE

[75] Inventor: Jae K. Lee, Kyungsangbook-Do, Rep. of Korea

[73] Assignee: GoldStar Co., Ltd., Rep. of Korea

[21] Appl. No.: 812,475

[22] Filed: Dec. 23, 1991

[30] Foreign Application Priority Data

Dec. 29, 1990 [KR] Rep. of Korea ..... 90-22407

[51] Int. Cl.[5] ..... G03C 5/00

[52] U.S. Cl. ..... 430/23; 430/24; 427/64; 427/68; 427/72

[58] Field of Search ..... 430/23, 24; 427/64, 427/68, 72

[56] References Cited

U.S. PATENT DOCUMENTS 3,954,470 5/1976 Barczynski et al. ..... 430/24

FOREIGN PATENT DOCUMENTS 62-076132 4/1987 Japan .
79-3493 3/1983 Rep. of Korea .

*Primary Examiner*—Marion E. McCamish
*Assistant Examiner*—Mark A. Chapman
*Attorney, Agent, or Firm*—Morgan & Finnegan

[57] ABSTRACT

A method of forming a phosphor layer on the screen panel of a cathode-ray tube include the steps of charging phosphor slurry on the inside of the screen panel, rotating the screen panel to spread the phosphor slurry forming the phosphor layer, and exposing the screen panel to a light disposed in front of the inside of the screen panel and a plurality of lights disposed in front of the outside of the screen.

1 Claim, 2 Drawing Sheets

METHOD OF FORMING A PHOSPHOR LAYER ON THE SCREEN PANEL OF A CATHODE-RAY TUBE

FIELD OF THE INVENTION

The present invention concerns a method of forming a phosphor layer on the screen panel of a color picture tube, and more particularly a method of exposing the peripheral portions of the phosphor layer.

BACKGROUND OF THE INVENTION

Generally, the screen forming process of a color picture tube is to form a three-color phosphor layer, comprising the steps of black coating and screen coating.

The black coating is to spread a non-reflective black paint on the inside of the screen panel to absorb unwanted light emission caused by scattered electrons generated between phosphor stripes or external light in order to enhance the contrast, while the screen coating is to spread the phosphors of three colors (Green, Blue, Red) in the holes between the black stripes formed by the black coating.

In order to form the phosphor layer, after a plurality of light-absorbing black stripes 6 are formed on the inside of the screen panel 2 as shown in FIG. 2, a green phosphor slurry comprising a phosphor powder, salt of chromic acid that is light-sensitive, polyvinyl alcohol and surfactant is loaded on the inside of the screen panel 2 rotated with a high speed to spread the phosphor slurry over the whole surface of the panel.

The phosphor slurry layer on the inside of the panel is dried, and then exposed to light developing into the holes of green, blue and red. If the panel and shadow mask are connected and exposed to an infrared light source 4 as shown in FIG. 3, the portions of the phosphor layer illuminated with the infrared ray become insoluble by light coupling reaction between the polyvinyl alcohol (PVA) and salt of chromic acid firmly adhered to the panel. Further the outer side of the panel is exposed to a light source 5 in order to enhance the effect of the infrared light source 4. Likewise the blue and red phosphor layers are sequentially formed.

In this conventional method of forming the phosphor layer on the screen panel, when the panel 2 is rotated with a high speed to spread the phosphor slurry over the whole surface, the central portion of the panel 2 hardly receives the centrifugal force, and the phosphor slurry disposed in the corners is hindered from spreading by the skirt portions 2*a*. Consequently, the phosphor layer 1 comes to have thicker portions in the central and corner regions than in the other regions, as shown in FIG. 1.

The thicker central and corner portions of the phosphor layer 1 do not receive the light of the infrared light source 4 enough to influence the depth, so that the phosphor layer 1 may be separated during development. Furthermore, in order to resolve this problem if the light intensity of the infrared light source is increased, the relatively thinned portions of the phosphor layer are excessively exposed to the light, and the width of the stripe 7 is widened to the positions of the phosphor layers of different colors so as to impair the clearness of the screen colors of images. In addition, the light source 5 such as incandescent lamp disposed in front of the central portion of the outer side of the panel 2 may prevent the separation of the central portion of the phosphor layer, but there is not resolved the problem caused by inadequacy of the exposing light in the corner portions.

SUMMARY OF THE INVENTION

The object of the present invention is to provide a method of forming a phosphor layer comprising uniform stripes on the screen panel of a cathode-ray tube, which realizes clear screen images.

According to the present invention, there is provided a method of forming a phosphor layer on the screen panel of a cathode-ray tube comprising the steps of charging phosphor slurry on the inside of the screen panel, rotating the screen panel to spread the phosphor slurry forming the phosphor layer, and exposing the screen panel to a light disposed in front of the inside of the screen panel and a plurality of lights disposed in front of the outside of the screen.

The present invention will now be described more specifically with reference to the drawings attached only by way of example.

BRIEF DESCRIPTION OF THE ATTACHED DRAWINGS

DETAILED DESCRIPTION OF THE INVENTION

The present invention is characterized by a plurality of lights for exposing the outer side of the screen panel together with a infrared light source 4 for directly exposing the phosphor slurry spread on the inner side of the panel.

Figure 1:
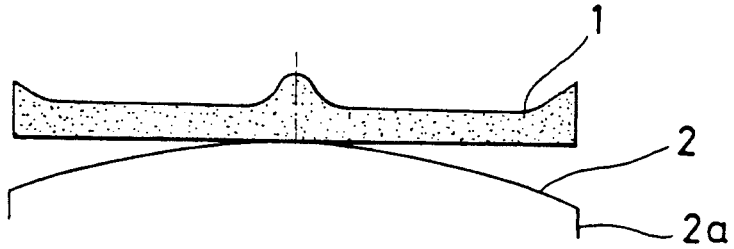
FIG. 1 is a schematic diagram for illustrating the cross section of a phosphor layer formed according to a conventional method.
Figure 2:
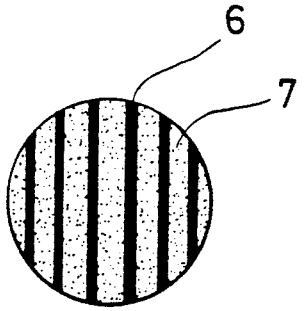
FIG. 2 is an enlarged view of the stripes of the phosphor layer formed according to the conventional method.
Figure 3:
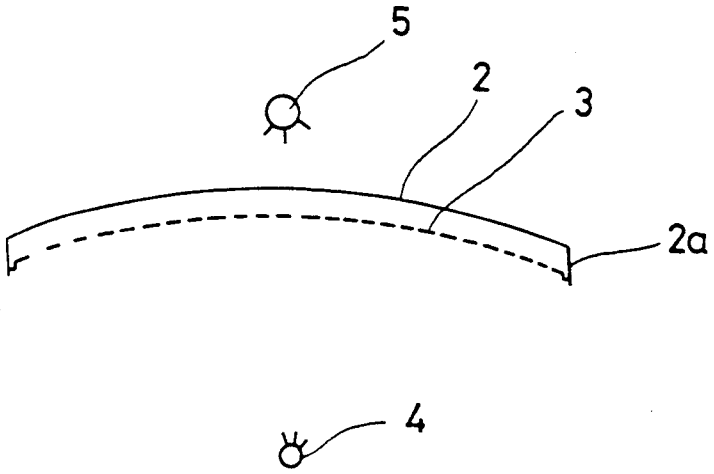
FIG. 3 illustrates the light exposing arrangement of the conventional method.
Figure 4:
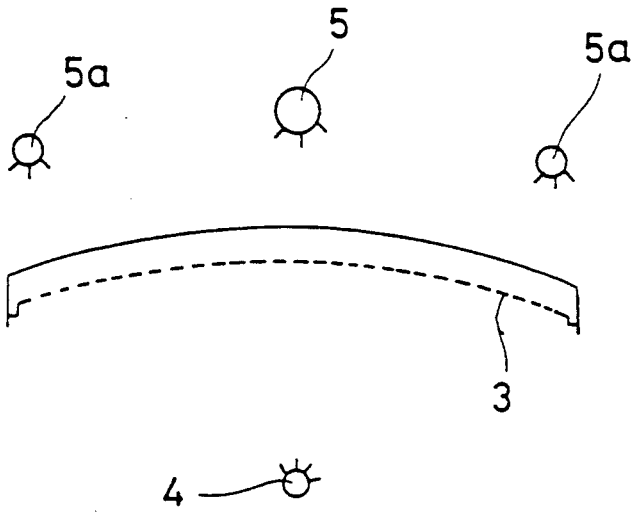
FIG. 4 illustrates the light exposing arrangement of the inventive method.

Referring to FIG. 4, there are shown a plurality of back lights 5 and 5*a* for exposing the outer side of the panel in order to improve the light exposition of the thickened portions in the central and corner regions of the phosphor slurry layer spread over the inside of the panel. An infrared light source 4 is disposed in front of the inside of the panel, while the back central light 5 is disposed in front of the central portion of the outer side of the panel with the back corner lights 5*a* disposed in front of the corners. The infrared light source and back lights are simultaneously turned on.

The panel coated with the phosphor slurry layer is mounted on a light exposing apparatus to expose the phosphor slurry layer to light. The infrared light source 4 and back lights 5 and 5*a* may be automatically turned on and off by an optical sensor.

It is preferable that the luminosity of the corner lights 5*a* have about 20–70% of that of the central light 5.

If the panel coated with a green, blue and red phosphor slurries is covered with the shadow mask, and mounted on the light exposing apparatus, the shutter of the light exposing apparatus is opened by the operation of the optical sensor, so that the inside of the panel is exposed to the infrared light source 4. Then the portions of the phosphor layer exposed to the infrared light through the slots of the shadow mask 3 are firmly adhered to the panel by the light coupling reaction between the PVA and salt of chromic acid.

The thicker central and corner portions of the phosphor layer also undergo sufficient light coupling reaction with the help of the central and corner lights 5 and 5*a*, thus providing uniform stripes 7*a* over the whole surface of the panel.

Figure 5:
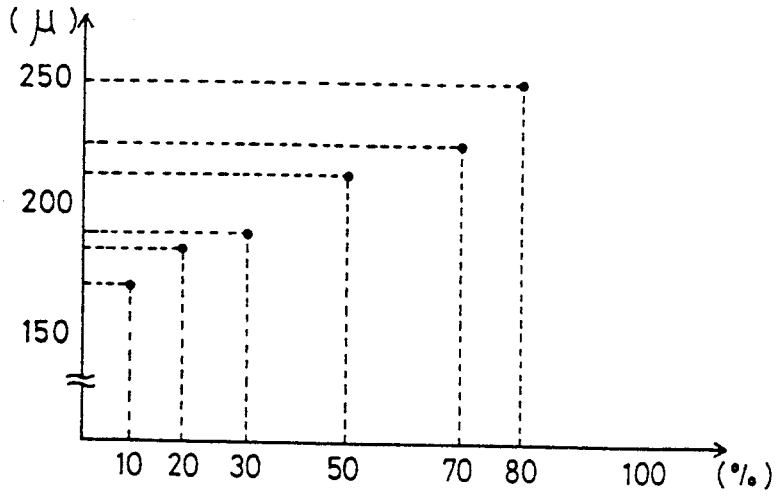
FIG. 5 illustrates the variation of the width (u) of the phosphor stripe with the luminosity of the lights disposed in front of the corners of the outer side of the panel according to the present invention.

FIG. 5 is a graph for illustrating the changes of the width of the stripe with variation of the luminosity of the back corner lights 5*a* provided the luminosity of the infrared light source 4 and back central light 5 is fixed to 100W for obtaining the optimum stripe of the phosphor layer 1. As shown by the graph, the luminosity of the back corner lights 5*a* must be in the range of 20–70W in order to obtain a desired stripe of the phosphor layer.

As stated above, the back central and corner lights provided in front of the outer side of the panel help the whole surface of the panel be uniformly exposed to the light, thus providing desired phosphor layer stripes. Thus the corner portions of the phosphor layer are not separated from the panel so as to improve the quality of the cathode-ray tube, and even if the portions of the phosphor layer is separated during manufacturing, the back lights may be promptly and properly adjusted so as to prevent the separation. Moreover, the whole surface of the phosphor layer may be uniformly exposed to the light within a short time, which improves the productivity.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A method of forming a phosphor layer on a screen panel of a cathode-ray tube, consisting of the steps:

charging phosphor slurry on the inside of said screen panel;

rotating said screen panel to spread said phosphor slurry forming said phosphor layer; and exposing said screen panel and said phosphor layer to a light disposed in front of the inside of said screen panel and a plurality of lights disposed in front of the outside of said screen panel, wherein said plurality of lights disposed in the front of the outside of said screen panel are respectively disposed in front of a central portion and four corners of said screen panels.

* * * * *